United States Patent [19]

Chia et al.

[11] Patent Number: 4,566,524

[45] Date of Patent: Jan. 28, 1986

[54] METHOD OF AND APPARATUS FOR CASTING A COMPOUND METAL BAR

[75] Inventors: E. Henry Chia; Ronald D. Adams, both of Carrollton, Ga.

[73] Assignee: Southwire Company, Carrollton, Ga.

[21] Appl. No.: 446,128

[22] Filed: Dec. 2, 1982

[51] Int. Cl.[4] ..... B22D 11/00; B22D 19/08

[52] U.S. Cl. ..... 164/461; 164/453; 164/482; 164/488; 164/490

[58] Field of Search ..... 164/461, 479–482, 164/427–434, 490, 440, 453

[56] References Cited

U.S. PATENT DOCUMENTS 3,295,173 1/1967 Webber et al. ..... 164/461 X
3,421,571 1/1969 Webber et al. ..... 164/461
3,428,111 2/1969 Gyongyos et al. ..... 164/488 X

FOREIGN PATENT DOCUMENTS 57-75256 5/1982 Japan ..... 164/461

*Primary Examiner*—Kuang Y. Lin
*Attorney, Agent, or Firm*—Herbert M. Hanegan

[57] ABSTRACT

Disclosed are method of and apparatus for continuously casting a compound metal bar, the bar comprising a core member encased in a clad member which in combination form a unitary metal matrix. Said compound metal bar is cast by continuously pouring a first molten metal into a casting mold and discharging a second molten metal beneath the surface of the first molten metal beneath the surface of the first molten metal and continuously solidifying both molten metals to form said compound metal bar.

4 Claims, 7 Drawing Figures

18
12
20
19
13
11
14
10

METHOD OF AND APPARATUS FOR CASTING A COMPOUND METAL BAR

BACKGROUND OF THE INVENTION

This invention relates to a method for casting and rolling a compound metal bar and rod which comprises a core and a sheath which completely encases the core. The invention more particularly is a method for casting and rolling a compound metal bar which comprises a core and a sheath which completely encases the core and which together form a unitary metal matrix.

Various methods have been used in the past to produce bar having a compound structure but such methods have typically produced a product in which there was a mechanical joining of the core and sheath. Such products have generally been produced by either plating or dipping processes but on occasion these products have been produced by casting continuous lengths of bar using the method disclosed in U.S. Pat. No. 3,421,571 and the apparatus disclosed in U.S. Pat. No. 3,421,571 and the apparatus disclosed in U.S. Pat. Nos. 3,295,173 and 3,295,174. Additionally, apparatus related to pouring molten metal into a casting machine is disclosed in U.S. Pat. Nos. 3,428,111, 3,431,971 and 3,548,919. Related apparatus is also discussed in U.S. Pat. Nos. 105,112, 112,054, 1,507,456, 1,702,528 and 2,348,178; British Pat. No. 948,116 and Italian Pat. No. 566,874.

The method disclosed in U.S. Pat. No. 3,421,571 involves continuously forming a partially stabilized tube-like sheath of cladding metal and filling it with a core metal and cooling both into a bar. Critical to this method is the partial oxidation of the interior surface of the cladding metal so that mixing of the cladding and core metals is physically prevented by an oxide layer located between the two. Such procedures have resulted in a usable, but metallurgically unstable and tenuous union between the cladding metal and the core metal. Additionally, difficulties have been encountered with the prior art bar which relate to the drawing of the bar into smaller diameter wire of various sizes, particularly when it is desired to have the wire product clad with a metal composition different from the composition of the core metal.

DISCLOSURE OF THE INVENTION

It is therefore a principal object of the present invention to provide a process for casting a metal bar from molten metal, the core of which is clad with a freshly cast metal tube into which the core is injected while in a molten condition.

Another object of the present invention is to provide a process for casting from molten metal a continuous compound metal bar comprising a core and sheath, each consisting of a different metal composition, which together form a unitary metal matrix.

Yet another object of the present invention is to provide a process for pouring two molten metal alloys into a continuous casting mold in a non-turbulent manner so that no significant amount of diffusion or mixing will occur between the two liquid metals before the alloys solidify.

Still another object of the present invention is to provide a process for pouring a first molten metal alloy from a tube submerged in a second molten metal alloy to thereby continuously cast a compound metal bar with a core of the first alloy and a sheath of the second alloy.

Another object of the present invention is to provide a process for casting a compound metal bar comprising a core and a cladding section each of variable thickness which can be controlled during the casting process.

Still another object of the present invention is to provide a process for casting a compound metal bar in which no substntial oxide layer separates the cladding section of the bar from the core section of the bar.

Another object of the present invention is to provide a process for casting a compound metal bar wherein intermixing of core metal and cladding metal is prevented by the maintenance of a pressure differential between the cladding metal and the core metal during pouring.

Another, and important object of the present invention is to provide a process for casting a compound metal bar in which oxidation of either the core metal or cladding metal is substantially prevented at the interface between the two.

Another object of the present invention is to provide a continuous method of manufacturing a compound metal bar which is less subject to inverse segregation.

Yet another object of the present invention is to provide a method of manufacturing a compound metal bar which is less subject to cracking.

Still another object of the present invention is to provide a method of manufacturing a compound metal bar by casting at least two metal alloys simultaneously.

Another object of the present invention is to provide a method of manufacturing a compound metal bar which is resistant to surface cracking during rolling.

An additional object of the present invention is to provide a method of manufacturing a compound meal bar with improved surface lubrication characteristics which facilitate rolling the bar into rod.

Still another and important object of the present invention is to provide a process for casting a compound metal bar which promotes bonding of the molten core and molten cladding metal without undesired diffusion along the boundary between the two to form a unitary metal matrix while maintaining the core and cladding metals as metallurgically distinct metals or metal alloys.

Another object of the present invention is to provide a process for casting a compound metal bar from a variety of alloy compositions and thereby produce a bar product which possesses enhanced drawability, improved corrosion resistance and little or no inverse segregation.

Details of the foregoing objects, features and advantages of the invention as well as other objects thereof are set forth in the following description of the preferred embodiments of the invention and are illustrated in the accompanying drawings comprising a part thereof.

BEST MODE FOR CARRYING OUT THE INVENTION

Figure 1:
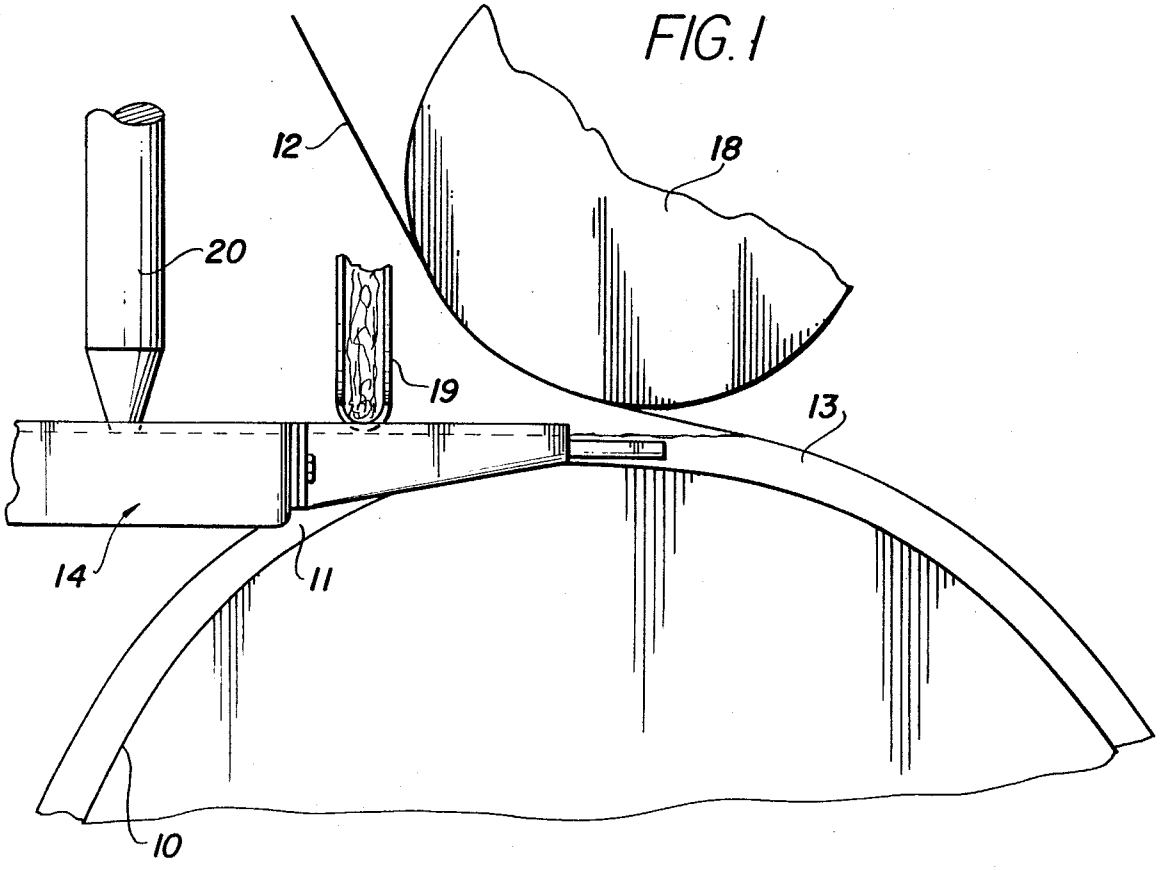
FIG. 1 is a diagramatic representation in cross section of pouring apparatus for the practice of the present invention.

FIG. 1 generally depicts one embodiment of the present invention. The apparatus of this embodiment includes a casting wheel 10 which has a peripheral groove 11 inscribed about its circumference. Groove 11 in cooperation with band 12 form the casting mold 13 into which molten metal is poured from tundish 14.

Figure 2:
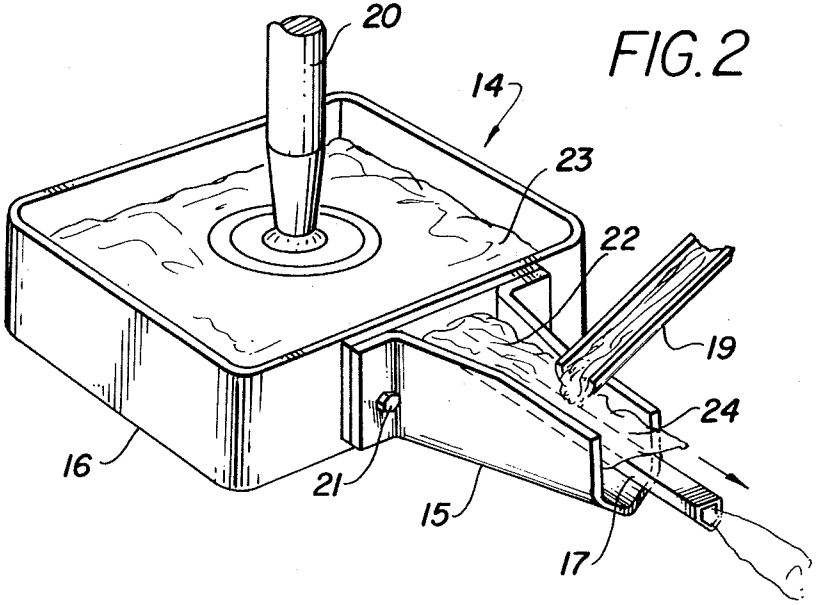
FIG. 2 is a pictorial representation of the pouring apparatus used to practice the present invention.
Figure 3:
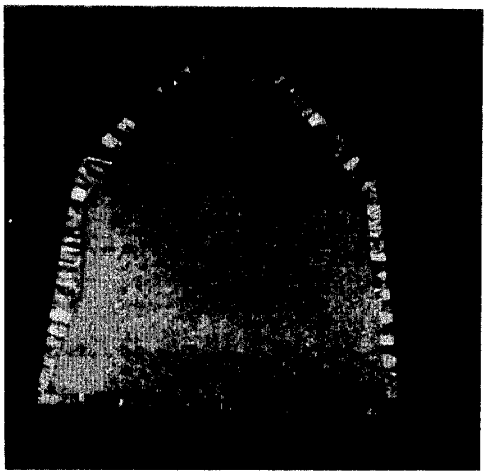
FIG. 3 is a pictorial representation in cross-section of a compound metal bar manufactured in accordance with the method of the present invention.
Figure 4:
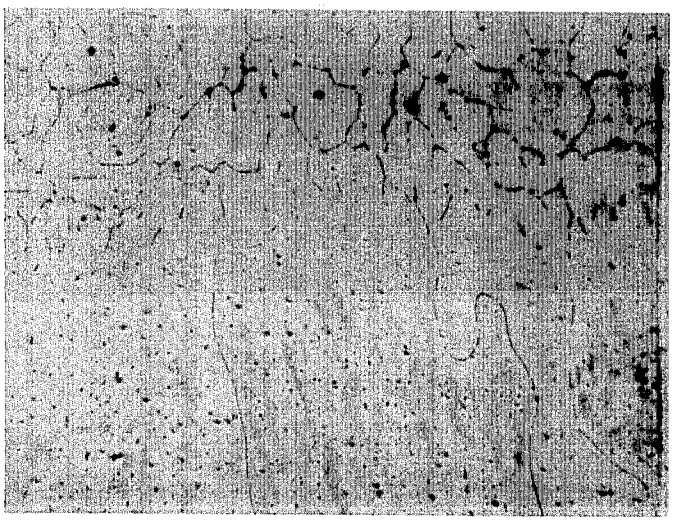
FIG. 4 is a photo micrograph of the cladding-core interface of the compound metal bar shown in cross-section in FIG. 3.
Figure 5:
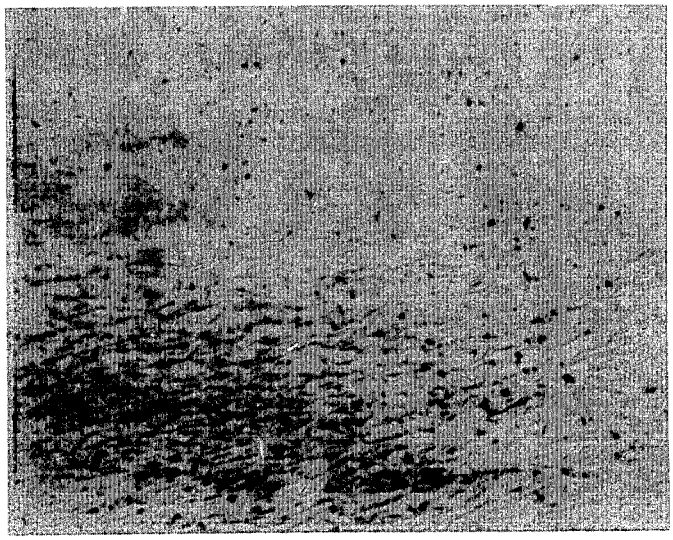
FIG. 5 is a photomicrograph of the cladding-core interface of a compound metal rod rolled from a compound metal bar produced in accordance with the method of the present invention.
Figure 6:
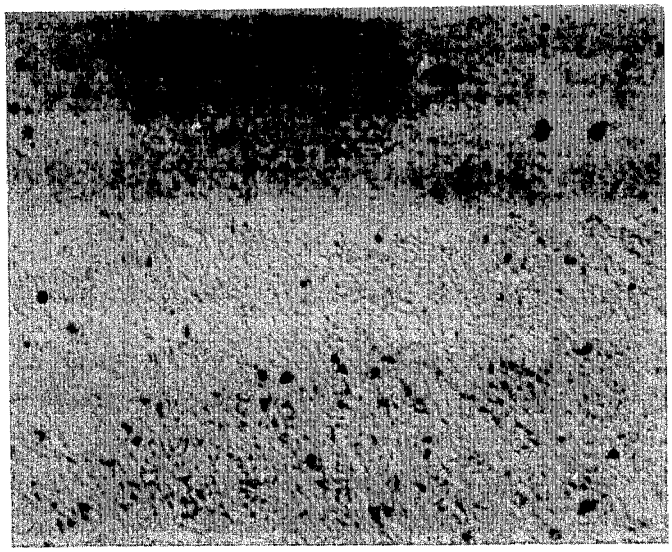
FIG. 6 is a photomicrograph of the cladding-core interface of a compound metal bar produced in accordance with the method of the present invention.

Tundish 14, as shown in FIG. 2, is made in two parts, rectangular pot 16 and open trough 15. The rectangular pot 16 and open trough 15 are bolted together. A metal delivery tube 17 extends from pot 16 through trough 15 and into mold 13 at a point below the surfaces of molten metal in mold 13 and beyond the point at which trough 15 fits into groove 11 of casting wheel 10. Trough 15 must fit groove 11 of casting wheel 10 so that trough 15 does not hang in groove 11, and so that molten metal does not flow backward into casting groove 11. If trough 15 hangs in groove 11, tundish 14 could be damaged before casting wheel 10 could be stopped. These parts are coated with an oxide coating to increase their thermal stability.

The tundish 14 is horizontally and pivotally mounted so that the delivery end of open trough 15 and delivery tube 17 match the cross-section of mold 13 even if the casting wheel 10 ceases to be a perfect circle because of thermal distortion. Molten metal flows from the tundish 14 to the mold 13 with little or no turbulence. Band 12 is held tightly against the periphery of wheel 10 by counter wheel 18 so that band 12 and wheel 10 are sealingly engaged to form, in cooperation with groove 11, mold 13.

FIG. 2 shows in more detail tundish 14, and the pot 16 and open trough 15 which cooperate to form tundish 14. Also shown in FIG. 2 are clad metal delivery means 19 and core metering spout 20 from which molten core metal 23 and cladding metal 24 are poured into tundish 14 from separate holding furnaces which are not shown.

Referring again to FIG. 1, molten core metal from a holding furnace, not shown, is transferred to an intermediate pot, also not shown, the purpose of which is to settle the metal flow before the metal arrives in tundish 14. A steady and smooth flow of metal and a constant metal level in this pot helps to keep a steady metal level in tundish 14 without resorting to adjustment of the flow control mechanism, also not shown. The intermediate pot needs no adjustment but must be capable of rapid draining should an emergency shut down become necessary. Additionally the intermediate pot is positioned to avoid spilling of molten metal on to the tundish if an overflow should occur.

Molten core metal 23 enters rectangular pot 16 through spout 20 and flows horizontally through metal delivery tube 17 which projects through the wall of pot 16, through open trough 15 and into mold 13. Molten cladding metal 24 enters open trough 15 through clad delivery means 19. The level of clad metal 24 in open trough 15 is maintained such that metal delivery tube 17 is completely submerged in molten clad metal 24 during casting. Molten clad metal flows horizontally into mold 13 from open trough 15. During casting, delivery tube 17 is also smbmerged below the surface of clad metal 24 in mold 13 and core metal 23 is injected into the molten pool of cladding metal 24 under sufficient metalostatic pressure to cause the molten cladding metal 24 to be forced away from the center and toward the periphery of mold 13 thereby urging the solid clad against the walls of the mold and preventing its collapse into the core metal at the center of mold 13.

This casting process makes possible the control of the thickness of the cladding by controlling the feed rates of the two metals being zone cast. In addition, the process advantageously prevents oxidation of the core metal and the transition between the core and clad metals during casting and provides a way to control the metallurgical characteristics of the transition zone between the core and the clad metals. Such control is necessary because some alloy systems will crack during working due to inhomogeneous deformation produced by the dissimilarity of working characteristics of the two metals. By adjusting cooling rate, delivery tube length, and metal temperature and controlling turbulance, diffusion of core and clad metals in the transition or bonding zone can be retarded or promoted to a greater or lesser degree depending upon the alloy system being cast.

Both the pot 16 and trough 15 are designed for side delivery rather than bottom pouring to prevent formation of a vortex in the molten metals because quiet flow of the metals being cast is important to obtain a cast product of acceptable quality. Quite flow allows the metals to be poured into the mold without substantial mixing at the transition zone of the clad metal 24 and core metal 23 in mold 13.

The formation of an acceptable cast compound product which has a metallurgically distinct core and clad portions is dependent upon several operational variables. Among the variables affecting the production of continuously cast compound bar of the type disclosed and claimed herein are: the alloy systems being cast, the length of the core metal delivery tube; the pressure differential between the molten clad and molten core metals at pouring; the absolute pouring pressure of the clad metal; the rate of initial chill of the clad metal as it enters the mold; the rate of solidification of the clad metal in the casting mold; the rate at which the mold is cooled; the uniformity of cooling distribution of the mold; the temperatures of the molten clad and core metals; the temperature differential between the molten core and clad metals; mold rotation rate; delivery tube placement in the mold; and solidification rate to pour rate relationship.

It has been found that the pour rate of molten core 23 decreases because of frictional losses which occur as molten core 23 flows through delivery tube 17 into mold 13. In order to have a sound cast bar it has been found that it is necessary to increase the head pressure of molten core 23 by an amount equal to the frictional losses which occur in delivery tube 17. It has also been found that the magnitude of the difference in pressure between molten clad metal 24 and molten core metal 23 is not as important as is maintaining such pressure difference constant so that variations of the level of molten metal in mold 13 are essentially eliminated.

Practice of the invention has demonstrated that to insure the application of a sound clad to the core it is advantageous to pour a slight excess of clad metal and allow some dilution of the core at the core-clad transition zone. One method of accomplishing this is by adding a small baffle 71 to or near the end of delivery tube 17 to insure that enough mixing occurs at the core-clad transition zone to insure the development of a unitary metal matrix in that zone.

In order to achieve an acceptable continuously cast compound bar it is preferable to solidify enough clad metal to form an initial clad skin equal to a minimum of about 10 percent of the total cross-section aluminum area of the bar being cast before the clad metal passes the tip of delivery tube 17 in its progression to mold 13. If this is not achieved, molten core metal may flow behind the solidifying front of clad metal and penetrate to the surface of the bar through the still molten clad metal 23.

It is also desirable to balance a rapid initial chill with conditions which will result in a faster overall cooling rate. This may be accomplished by the application of a mold dressing which slows the rate of metal freezing in the first few inches of mold thereby reducing the air gap which occurs between the walls of mold 13 and the cast bar during solidification. This procedure effectively increases the rate at which heat is removed from the molten metal thereby causing the bar to solidify more rapidly.

It has been found that a casting temperature between about 1245° F. and 1270° F. and a clad casting temperature between about 1280° F. and 1320° F. result in the production of a sound compound bar. It has also been found that a sound cast bar is produced when the exit temperature of the cast bar from the mold is between about 850° F. and 900° F. and the bar is preheated to about 920° F. before rolling.

In a preferred embodiment of the present invention the molten cladding metal 24 is the first metal to contact the wheel.

As previously mentioned, delivery tube 17 extends past open trough 15 from about two to about 12 inches to allow any turbulence at the point of pouring or at the mold to subside before flowing the core metal into mold 13 thereby preventing any significant undesired mixing from occurring before the clad solidifies in the mold. Delivery tube 17 is completely submerged in molten cladding metal 24 from the point at which delivery tube 17 enters open trough to the point in mold 13 at which molten core metal 23 is discharged into mold 13. Thus, as molten cladding metal 24 flows around delivery tube 17 on its path through open trough 15 to mold 13 molten core metal 23 exits tube 17 under a slightly higher pressure than the surrounding molten cladding metal 24 and equalizes pressure to displace the molten cladding metal 24 from the center of mold 13. The pressure applied to core metal 23 must be sufficiently high to prevent reentry of cladding metal 24 into the center of mold 13 during the critical time interval between entry of molten metal into the casting mold and solidification of the cladding metal at the cladding metal to mold interface. The pressure differential between the core metal and the cladding metal must be such that cladding metal does not migrate to the core portion of the casting but cannot be so great that the core metal will penetrate the cladding.

Figure 7:
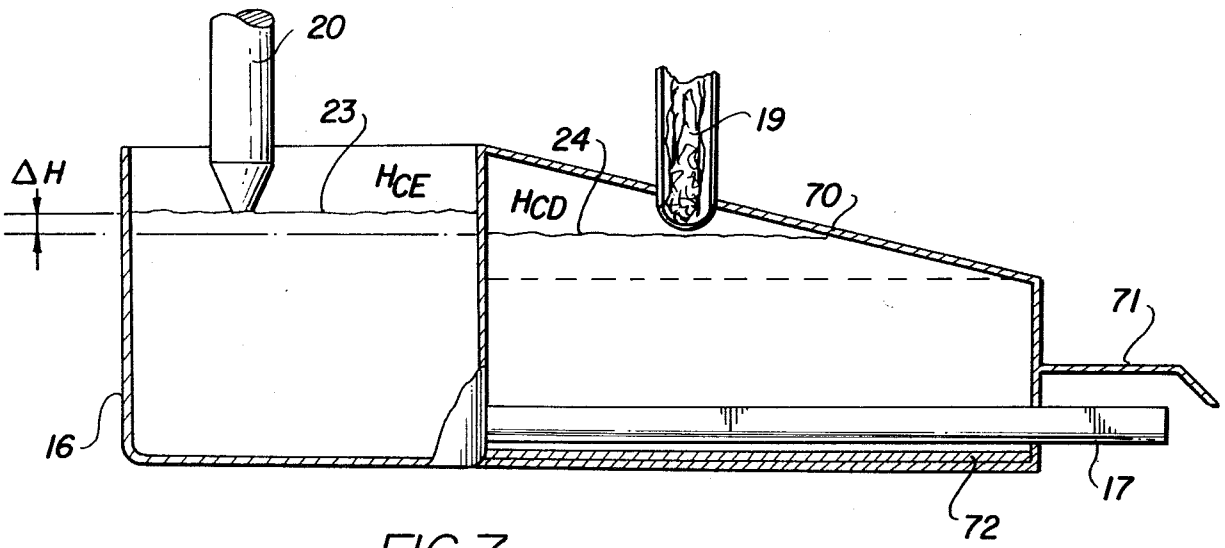
FIG. 7 is a pictorial representation of another embodiment of the pouring apparatus used in accordance with the method of the present invention.

It has been found that a head pressure differential $\Delta H$ of from about $\frac{1}{2}''$ to about $2\frac{1}{2}''$ greater for the core metal is satisfactory with a differential of $1\frac{1}{4}''$ being preferred. This relationship is shown schematically in FIG. 7. It should be understood that it is highly advantageous to keep the pressure differential constant in order to achieve a uniform cladding thickness. Consistency in this pressure differential has been achieved by covering open trough 15 with a refractory paper 70, such as a fiber frax paper, as shown in FIG. 7 and lining open trough with a similar refractory 72.

What is claimed is:

1. A method of continuously casting a compound metal bar having a core metal encased in a clad metal comprising the steps of:

continuously advancing a metal casting mold;

continuously substantially horizontally pouring a first molten metal into said mold from an opening in a side wall of a tundish;

continuously substantially horizontally discharging a second molten metal into the mold at a point submerged beneath the surface level of the first molten metal; and continuously solidifying said first and second metals to form said compound metal bar with substantially no oxidation at the interface between two molten metals.

2. A method according to claim 1 including the step of controlling the pressure differential between the discharge pressure of the second molten metal and the surrounding pressure of the first molten metal so that said differential remains constant thereby providing a uniform thickness of clad metal on said core metal.

3. A method according to claim 2 wherein said controlling step includes controlling the pressure head of said first and second metals so that the head of the second metal is greater than the head of the first metal.

4. A method of continuously casting a compound metal bar, said bar comprising a core member and a clad member wherein said core member is encased by said clad member, said core member and said clad member forming in combination a unitary matrix throughout, said method comprising the steps of:

a. continuously substantially horizontally pouring a first molten metal into a continuous casting wheel mold from an opening in a side wall of a tundish;

b. partially solidifying said first molten metal in said mold;

c. continuously substantially horizontally pouring a second molten metal into the partially solidified first molten metal, substantially without mixing said first and second molten metals at a transition zone between the two while allowing substantially no oxidation at the interface between two molten metals;

d. promoting diffusion of said molten metals about and along said transition to form a unitary metal matrix while maintaining said first and second molten metals as substantially metallurgically distinct entities;

e. continuously cooling said molten metals to form a compound metal bar; and f. continuously removing said compound metal bar from said mold.

* * * * *